US009771791B2

(12) United States Patent
Schulz et al.

(10) Patent No.: US 9,771,791 B2
(45) Date of Patent: Sep. 26, 2017

(54) APPARATUS AND METHOD FOR DRILL PIPE TRANSMISSION LINE CONNECTIONS

(71) Applicants: Rene Schulz, Hambühren (DE); Volker Peters, Wienhausen (DE)

(72) Inventors: Rene Schulz, Hambühren (DE); Volker Peters, Wienhausen (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 88 days.

(21) Appl. No.: 14/258,333

(22) Filed: Apr. 22, 2014

(65) Prior Publication Data

US 2015/0070185 A1 Mar. 12, 2015

Related U.S. Application Data

(63) Continuation-in-part of application No. 13/961,283, filed on Aug. 7, 2013.

(51) Int. Cl.

| | |
|---|---|
| ***E21B 47/18*** | (2012.01) |
| ***E21B 47/12*** | (2012.01) |
| ***E21B 17/00*** | (2006.01) |
| ***E21B 17/02*** | (2006.01) |

(52) U.S. Cl.

CPC ..... *E21B 47/122* (2013.01); *E21B 17/003* (2013.01); *E21B 17/028* (2013.01)

(58) Field of Classification Search

CPC ..... E21B 17/003; E21B 17/028; E21B 17/02; E21B 47/12; E21B 47/122; H04B 1/00; H01R 24/58

USPC ..... 340/854.3, 854.4, 854.5, 854.6, 854.9, 340/855.1, 855.2; 166/242.1, 242.2, 166/243.3

See application file for complete search history.

(56) References Cited

U.S. PATENT DOCUMENTS

| | | | | |
|---|---|---|---|---|
| 4,095,865 | A * | 6/1978 | Denison | E21B 17/003 340/855.2 |
| 5,611,329 | A | 3/1997 | Lamensdorf | |
| 6,392,317 | B1 * | 5/2002 | Hall | H02J 7/0047 307/10.2 |
| 7,017,667 | B2 * | 3/2006 | Hall | E21B 17/003 166/380 |
| 7,201,240 | B2 | 4/2007 | Hall et al. | |
| 7,852,232 | B2 | 12/2010 | Hall et al. | |

(Continued)

OTHER PUBLICATIONS

Hesser, "Technisches Zeichnen", Drehkörper, Chapter 7.3.6 , pp. 232-233.

(Continued)

*Primary Examiner* — Steven Lim
*Assistant Examiner* — Mancil Littlejohn, Jr.
(74) *Attorney, Agent, or Firm* — Cantor Colburn LLP

(57) ABSTRACT

An apparatus for communicating a signal downhole includes a downhole pipe configured to be coupled to another downhole pipe and a protection tube secured to the downhole pipe. A transmission line is disposed in the protection tube and configured to communicate the signal. A communication device is disposed in the downhole pipe and configured to communicate the signal to another downhole pipe. An end of the transmission line is configured to be axially movable with respect to the downhole pipe in order to have the end of the transmission line extending from the protection tube to establish a connection between the transmission line and the communication device.

17 Claims, 12 Drawing Sheets

(56) References Cited

U.S. PATENT DOCUMENTS

| | | | | |
|---|---|---|---|---|
| 2005/0087368 | A1 | 4/2005 | Boyle et al. | |
| 2007/0126596 | A1 | 6/2007 | Hall et al. | |
| 2007/0237467 | A1 | 10/2007 | Rubinstein et al. | |
| 2008/0251247 | A1 | 10/2008 | Flint et al. | |
| 2010/0071188 | A1* | 3/2010 | Madhavan ..... | E21B 17/028<br>29/428 |
| 2010/0264646 | A1* | 10/2010 | Follini ..... | E21B 17/003<br>285/119 |
| 2014/0299324 | A1 | 10/2014 | Pearl et al. | |

OTHER PUBLICATIONS

Notification of Transmittal of the International Search Report and the Written Opinion of the International Searching Authority; PCT/US2014/049872; Korean Intellectual Property Office; Mailed Nov. 14, 2014; 14 pages.

* cited by examiner

APPARATUS AND METHOD FOR DRILL PIPE TRANSMISSION LINE CONNECTIONS

BACKGROUND

Geologic reservoirs may be used for various purposes such as hydrocarbon production, geothermal production, or carbon dioxide sequestration. These reservoirs are typically accessed by drilling boreholes through the earth to the reservoirs.

A borehole is drilled using a drill bit that is rotated by drill pipes coupled together in series and generally known as a drill string. As the borehole is being drilled, several instruments or tools disposed at the drill string may perform measurements that may be used to monitor drilling operations or characterize the earth formation being drilled. In order to provide these measurements to an operator, processing system or controller disposed at the surface of the earth in real time, these measurements may be transmitted electrically via a transmission line or cable disposed in the drill string. Because signals carrying the measurement information must traverse all of the drill pipes between the signal source and a receiver disposed at the surface of the earth or at another position in the drill string, signal couplers are installed at the ends of the drill pipes. The signal couplers allow the signal to be transmitted from one drill pipe to the adjacent drill pipe that is connected to it. These couplers may be recessed into the drill pipe making it difficult to connect them to a signal transmission line, which is even further recessed in the drill pipe. Hence, apparatus and method that improves the process of making those connections would be well received in the drilling industry.

BRIEF SUMMARY

Disclosed is an apparatus for communicating a signal downhole. The apparatus includes: a downhole pipe configured to be coupled to another downhole pipe; a protection tube secured to the downhole pipe; a transmission line disposed in the protection tube and configured to communicate the signal; a communication device disposed in the downhole pipe and configured to communicate the signal to another downhole pipe; wherein an end of the transmission line is configured to be axially movable with respect to the downhole pipe in order to have the end of the transmission line extending from the protection tube to establish a connection between the transmission line and the communication device.

Also disclosed is a method for building or repairing an apparatus for communicating a signal downhole. The method includes: obtaining a downhole pipe configured to be coupled to another downhole pipe; securing a protection tube to the downhole pipe; and disposing a transmission line configured to communicate the signal into the protection tube; wherein an end of the transmission line is configured to be axially movable with respect to the downhole pipe in order to have the end of the transmission line extending from the protection tube.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method is presented herein by way of exemplification and not limitation with reference to the figures.

Disclosed are apparatus and method making connections to a signal transmission line disposed in a drill pipe. The transmission line is disposed in a protection tube in the drill pipe. The protection tube, which is separate and distinct from the transmission line, protects the transmission line from drilling fluid flowing in the interior of the drill pipe. The signal transmission line is made purposely longer than the length of the protection tube to allow for making an electrical connection outside of the protection tube. The length of the transmission line in excess of the protection tube length is selected to enable connection with a signal coupler that is configured to transmit signals to or receive signals from another signal coupler in a connected drill pipe or at or near the surface. After the connection is made, the excess length of the transmission line is stored in the protection tube. A small and, thus, light in weight transmission line is used. This type of transmission line does require it to be fixed or secured to the protection tube between end points of the protection tube in order to prevent damage to the transmission line as the transmission line is subject to vibrations and accelerations as a borehole is being drilled by the drill string. In contrast, a thicker transmission line, which is commensurately heavier, would need to be fixed to the protection tube in order to prevent it from being damaged by the vibrations and accelerations.

Figure 1:
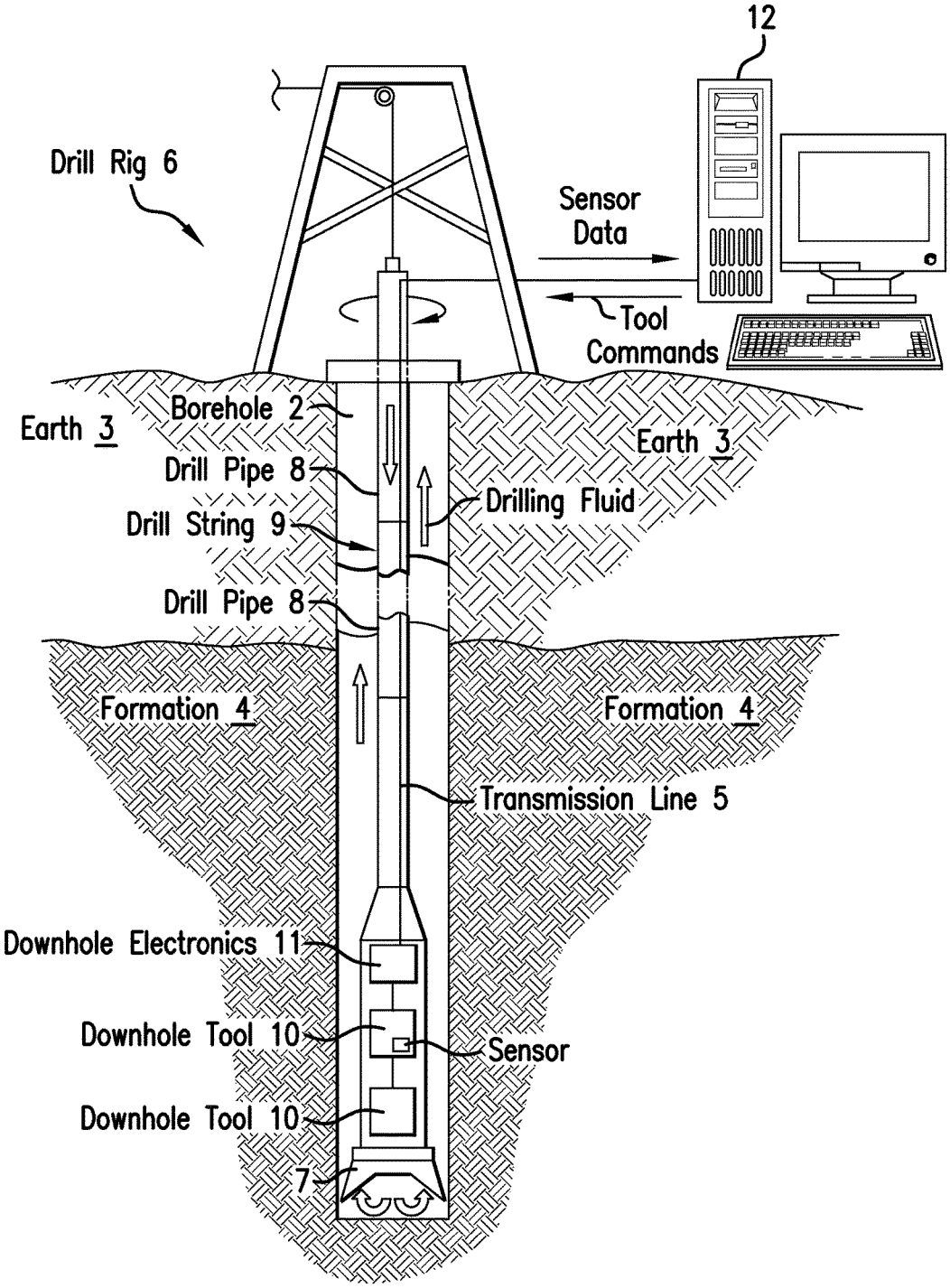
FIG. 1 illustrates a cross-sectional view of an exemplary embodiment of a drill string disposed in a borehole penetrating the earth.

FIG. 1 illustrates a cross-sectional view of an exemplary embodiment of a drill string 9 disposed in a borehole 2 penetrating the earth 3, which may include an earth formation 4. The drill string 9 is made up of a series of drill pipes 8 that are coupled together. In one or more embodiments, each drill pipe 8 has a box end and a pin end where the box end of one drill pipe 8 is configured to couple to the pin end of another drill pipe 8. A drill bit 7 is disposed at the distal end of the drill string 9. A drill rig 6 is configured to conduct drilling operations such as rotating the drill string 9 and thus the drill bit 7 in order to drill the borehole 2. In addition, the drill rig 6 is configured to pump drilling fluid through the interior of the drill string 9 in order to lubricate the drill bit 7 and flush cuttings from the borehole 2. Downhole tools 10 are disposed at (i.e., in or on) the drill string 9. The downhole tools 10 are configured to perform measurements related to monitoring drilling operations and/or characterizing the earth formation 4. Accordingly, the downhole tools may include a sensor. The downhole tools 10 may also be configured to perform actions such as retrieving a formation fluid sample. Downhole electronics 11 may be coupled to the downhole tools 10. The downhole electronics 11 are configured to operate the downhole tools 10, process measurement data obtained downhole, and/or act as an interface with telemetry to communicate data or commands between the downhole tools 10 and a computer processing system 12 disposed at the surface of the earth 3. The telemetry includes a transmission line 5 disposed in drill pipes 8. Electrical communication signals may be communicated between the drill pipes 8 using signal couplers 60 (FIG. 6) that may be recessed at mating surfaces of adjoining drill pipes. System operation and data processing operations may be performed by the downhole electronics 11, the computer processing system 12, or a combination thereof. The downhole tools 10 may be operated continuously or at a discrete selected depths or depth or time intervals in the borehole 2.

It can be appreciated that the transmission line 5 may be configured to convey electrical signals or optical signals. To convey electrical signals, the transmission line 5 may include one or more electrical conductors, and the signal couplers may be devices or antennas for electromagnetic communication between two electrical conductors. Other types of signal couplers for electrical signals may be capacitive, galvanic, or combination thereof. Non-limiting embodiments of the transmission line 5 for communicating electrical signals include a coaxial cable, a triaxial cable, a multiaxial cable, a twisted pair cable, a ribbon cable, and insulated conductors. To convey optical signals, the transmission line 5 may include one or more optical fibers and the signal couplers may be optical couplers having optical mating surfaces recessed in the drill pipe mating surfaces. It can be appreciated that in one or more embodiments the signal coupler may be configured to function as an optical-electrical converter for converting optical signals to electrical signals and/or for converting electrical signals to optical signals. It can be appreciated that in one or more embodiments the signal coupler may also be configured to function as a repeater or amplifier or to communicate with a repeater or amplifier.

As noted above, the transmission line is small and light in weight in order for the transmission line to remain operative as it is subject to vibrations and accelerations as a borehole is being drilled by the drill string. In one or more embodiments, the transmission line is very thin and its total weight within the protection tube is only tens of grams. The weight and the dynamic load, resulting from rotation and cyclic bending during the drilling process, are supported by an end signal connector of the transmission line. Dynamic changes in length of the drill pipe are compensated by the inherent surplus length of the transmission line. With 100 g dynamic acceleration, the dynamic connector load would be in the order of approximately 25 N (considering half of the weight supported by each side), which is a load the connector can withstand. One non-limiting embodiment of the transmission line for transmitting electrical signals is "Low Loss Microwave Coax, 28 AWG" available from TEMP-FLEX CABLE, INC. of Grafton, Mass. This coaxial cable has an outer diameter of 1.42 mm, impedance of 50 ohms, and weight of 5.5 kg/km. In one or more embodiments, if the transmission line or cable loss is not low enough for communication, it can be compensated by higher amplification. A combination of low loss transmission line and higher amplification may also be used.

Figure 2:
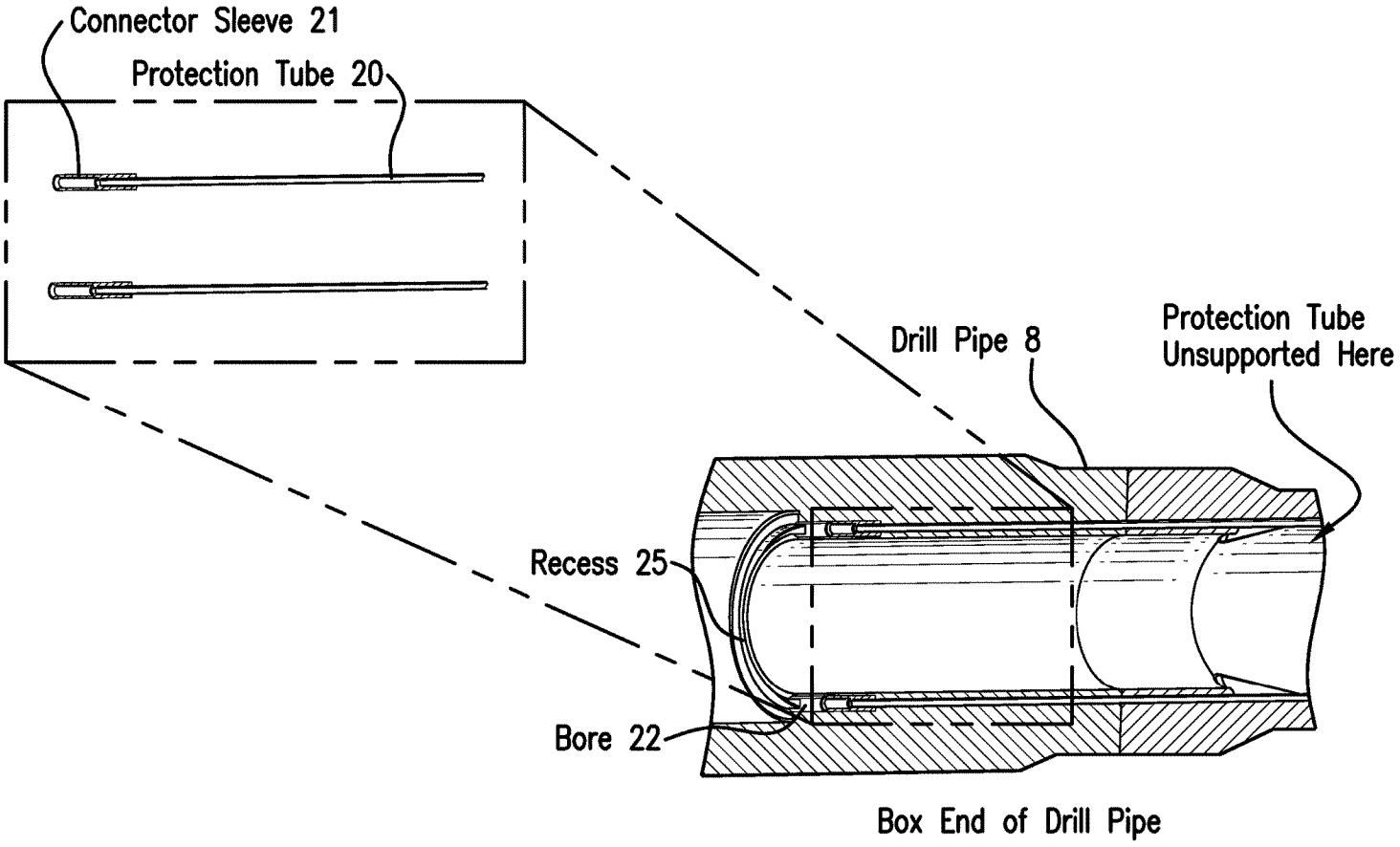
FIG. 2 depicts aspects of a protection tube and a connector sleeve disposed in a box end of a drill pipe.

Reference may now be made to FIG. 2 depicting aspects of a protection tube and a connector sleeve disposed in the box end of the drill pipe 8 in a cross-sectional view. Illustrated on the left side of FIG. 2 are a protection tube 20 and a connector sleeve 21 that is secured to the protection tube 20. The right side of FIG. 2 illustrates the protection tube 20 and the connector sleeve 21 being disposed within the box end of the drill pipe 8. The protection tube 20 traverses the drill pipe 8 from the box end to the pin end. The protection tube 20 is configured to contain the transmission line 5 (not shown in FIG. 2). By containing the transmission line 5, the protection tube 20 provides protection from the drilling fluid flowing within the drill pipe 8 and limits the range of movement of the transmission line 5 due to drill string vibration. By limiting the range of movement, the protection tube 20 may prevent cracks or damage from occurring in the transmission line 5 due to repetitive movement in response to drill string vibrations and accelerations. As illustrated in FIG. 2, a recess 25 is in a mating surface in the box end of the drill pipe. The recess 25 is configured to accept the corresponding signal coupler so that the outer surface of the signal coupler is flush or in close proximity to the end face. In other embodiments, the signal coupler may be fully recessed or it may protrude from the end face and be pushed in a final position when the connection is made. It should be noted that a "sleeve" in this application does not need to be a sleeve as commonly understood. It only needs to have a radially expanded element, which does not need to cover the complete circumference and which does not need to be rotationally symmetric with respect to an axis.

Two protection tubes 20 each secured to a connector sleeve 21 are illustrated in FIG. 2. Although not shown in the figures, it will be appreciated by those skilled in the art that only one protection tube may be fully functional for communicating signals or power downhole or from downhole to the surface. However, two or more protection tubes may be used to provide redundancy, multiple signal paths for different types of signals or for one type of signal using one conductor in each protection tube to form a signal path. Alternatively, one protection tube may be used to contain one transmission line. For discussion purposes one protection tube is discussed although the following figures may illustrate two individual protection tubes and corresponding connector sleeves.

Figure 3:
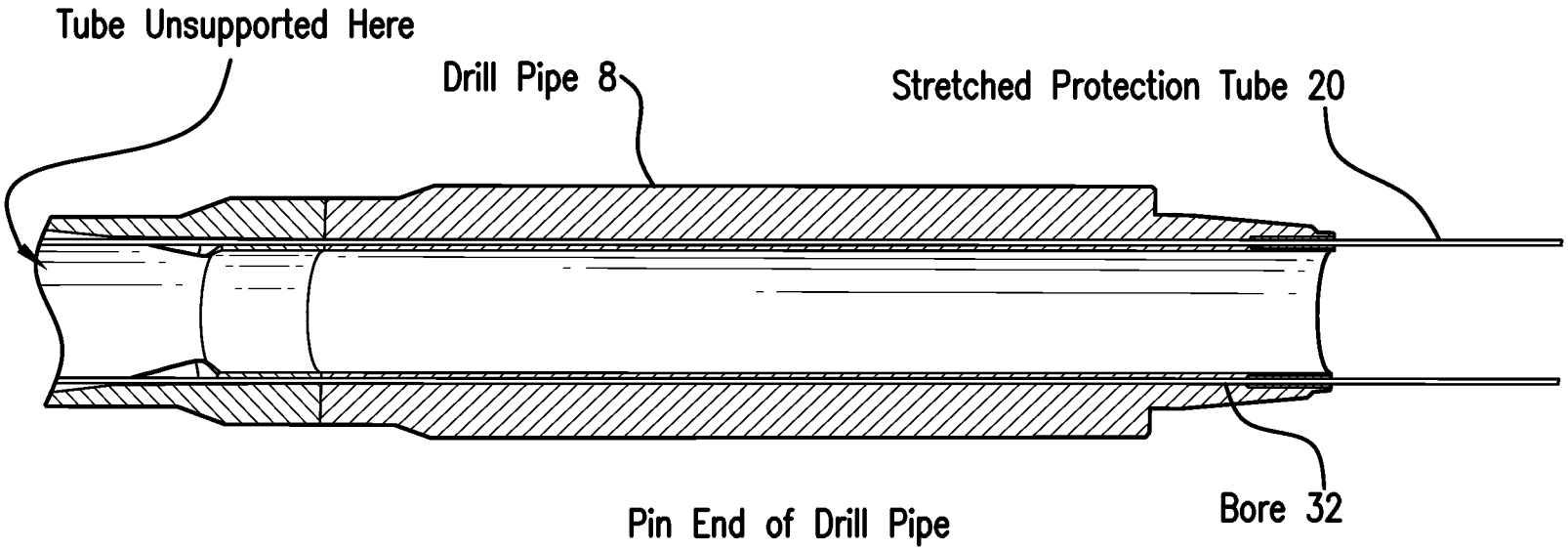
FIG. 3 depicts aspects of the protection tube disposed in and stretched in a pin end of the drill pipe.
Figure 4:
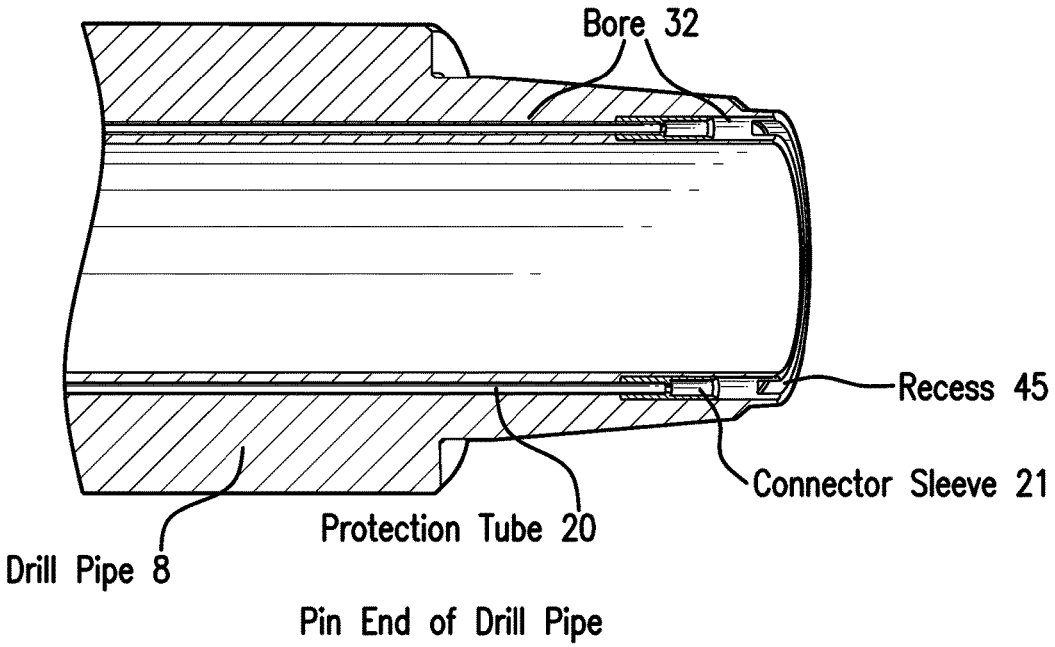
FIG. 4 depicts aspects of the protection tube and connector sleeve disposed in the pin end of the drill pipe.

As illustrated in FIG. 2, the protection tube 20 is disposed in a bore 22 in the box end. To the right of the bore 22, the protection tube 20 traverses the drill pipe 8 unsupported or unrestrained until the protection tube 20 enters a bore at the pin end of the drill pipe 8. In an installed configuration, the protection tube 20 is under axial tension (i.e. having at least a component of tension substantially parallel to the borehole axis), which can improve the rigidity and resistance to flexing of the protection tube 20, as well as abating any significant movement at the position of a connector during flexure and vibration of the drill pipe. That is, a part of the protection tube 20 is stretched a selected amount that is within the elastic deformation range of the protection tube 20 and secured in the drill pipe at each end using the connector sleeves. In one or more embodiments, a first connector sleeve is secured to one end of the protection tube and the protection tube is inserted into the bores of the drill string for accepting the protection tube until the installed connector sleeve engages the drill string such as at the box end. The outer diameter on the connector sleeve is generally greater than the outer diameter of the protection tube and the inner diameter of the bore 22 further in the drill pipe. That is, the bore 22 may have a first diameter further in the drill pipe to accommodate only the protection tube and a second diameter greater than the first diameter towards the end of the bore 22 to accommodate the connector sleeve surrounding the protection tube. Hence, the connector sleeve will engage the outside of the bore 22 preventing further movement of this end of the protection tube. The protection tube is then stretched beyond the end of a bore 32 at the pin end as illustrated in FIG. 3 and a second connector sleeve is secured to or near the end of the protection tube at this point. Once the connector sleeve 21 is attached at the pin end, the protection tube is released from stretching and retracts into the bore 32 due to the elasticity of the protection tube until the second connector sleeve engages the drill pipe as illustrated in FIG. 4. With both connector sleeves engaged to the drill pipe, the protection tube remains in axial tension. As illustrated in FIG. 4, there might be a recess 45 at the end face of the drill pipe at the pin end. The recess 45 is configured to accept the corresponding signal coupler so that the outer surface of the signal coupler is flush to the end face.

It can be appreciated that increasing the amount of stretching, but still being within the permitted material strain and the elastic deformation range, may increase the amount of rigidity and resistance to flexing and, thus, prevent damage from occurring in the protection tube 20. In addition, by resisting flexing the protection tube 20 may be held firmly in place so as not to interfere with tools that may be conveyed through the interior or the drill string 9. It can be appreciated that increasing the amount of stretching, but still being within the elastic deformation range, may increase the natural resonant frequency of the protection tube 20 such that the resonant frequency is tuned or shifted to prevent damage during drill string vibration.

It can be appreciated that in some embodiments minimum additional protection tube stretching might be required to attach one of the connector sleeves 21 before the protection tube 20 is allowed to retract into the drill pipe 8. For example, with a drill pipe that is 30 feet long, only about two inches or 0.5% additional stretch is required to attach one of the connector sleeves.

The protection tube 20 and the connector sleeve 21 can be made from a high strength material. The term "high strength" relates to the material having a high enough strength to be resistant to deformation during normal use and the above mentioned additional stretching during final assembly. In one or more embodiments, the protection tube and the connector sleeves are made from a metal alloy such as a high strength stainless steel alloy. Alternatively, in one or more embodiments, the protection tube is made from a composite material that has an elastic deformation property. Similarly, the connector sleeves may also be made of a composite material. It can be appreciated that other suitable materials may also be used either separately or in combination with the composite material. The materials for the protection tube and connector sleeves are selected to be compatible with a process for securing the connector sleeves to the protection tube. In one or more embodiments, the outer diameter of the connector sleeve 21 is greater than the outer diameter of the protection tube 20 and a securing process secures the connector sleeve to the protection tube. Non-limiting embodiments of the securing process include welding, brazing, soldering, friction fitting, swaging, screwing, using shape memory material, and applying an adhesive. The connections may be fluid tight by themselves or may be used in combination with a seal. Swaging may be performed hydraulically or by use of a ferrule. In one example of friction fitting, connector sleeves are in a cryogenic condition that contracts the inner diameter of these devices. When allowed to heat up, the diameter of these devices increases to provide the friction fit. Alternatively, a part may be heated up, assembled to another part, and then cooled down for a friction fit. It can be appreciated that any of these processes provides for a fluid tight seal that prevents drilling fluid from entering the protection tube and interfering with the transmission line.

While the protection tube 20 is illustrated as being straight from the box end to the pin end of the drill pipe 8, it can be appreciated that the protection tube can be deviated. The protection tube may be deviated using restraining devices (not shown) that are configured to restrain the protection tube radially and yet allow the axial tension to be conveyed axially. Alternatively, the bores in the drill pipe for accepting the protection tube may be deviated with respect to the center line of the drill pipe. Another deviation might be generated if the bores in the drill pipe for accepting the protection tube may be at different angles about the center line of the drill pipe. Finally, the drill pipe might be subject to bending during normal operation which can also create or vary deviation of the protection tube.

Figure 5:
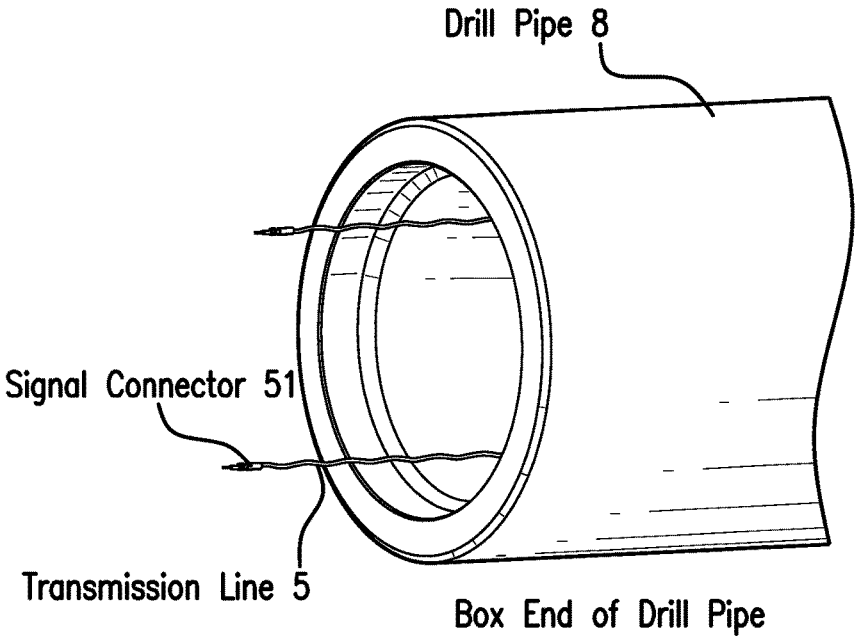
FIG. 5 depicts aspects of a transmission line with a signal connector extending from the box end of the drill pipe.
Figure 6A:
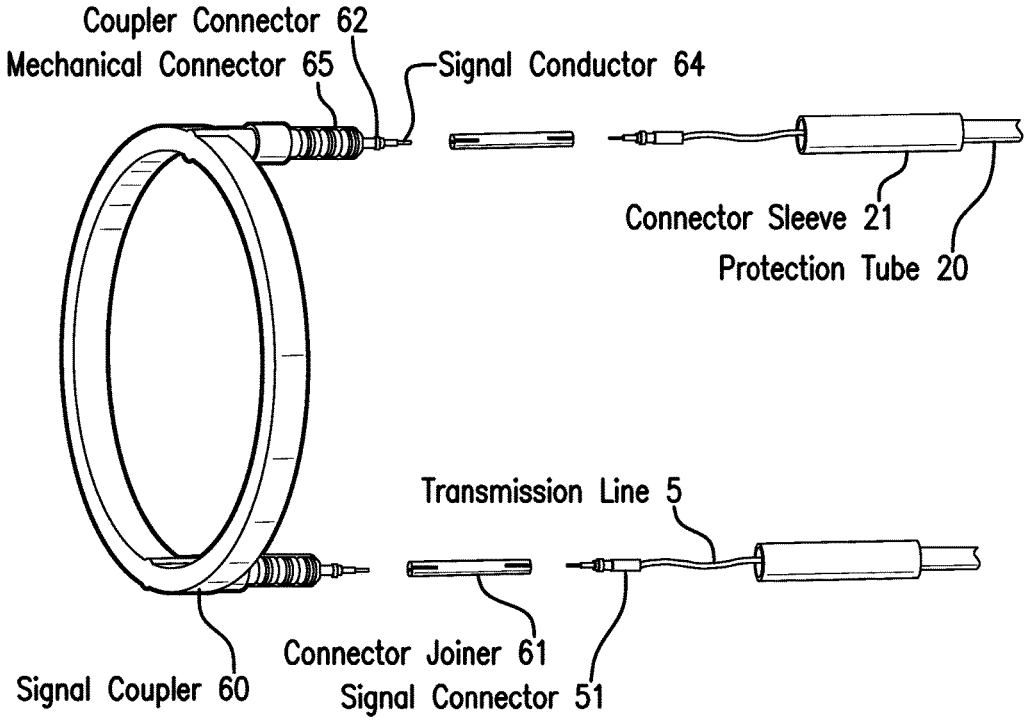
FIGS. 6A-6D, collectively referred to as FIG. 6, depict aspects of a signal coupler connected to a transmission line at the box end of the drill pipe using a female connector joiner.
Figure 6B:
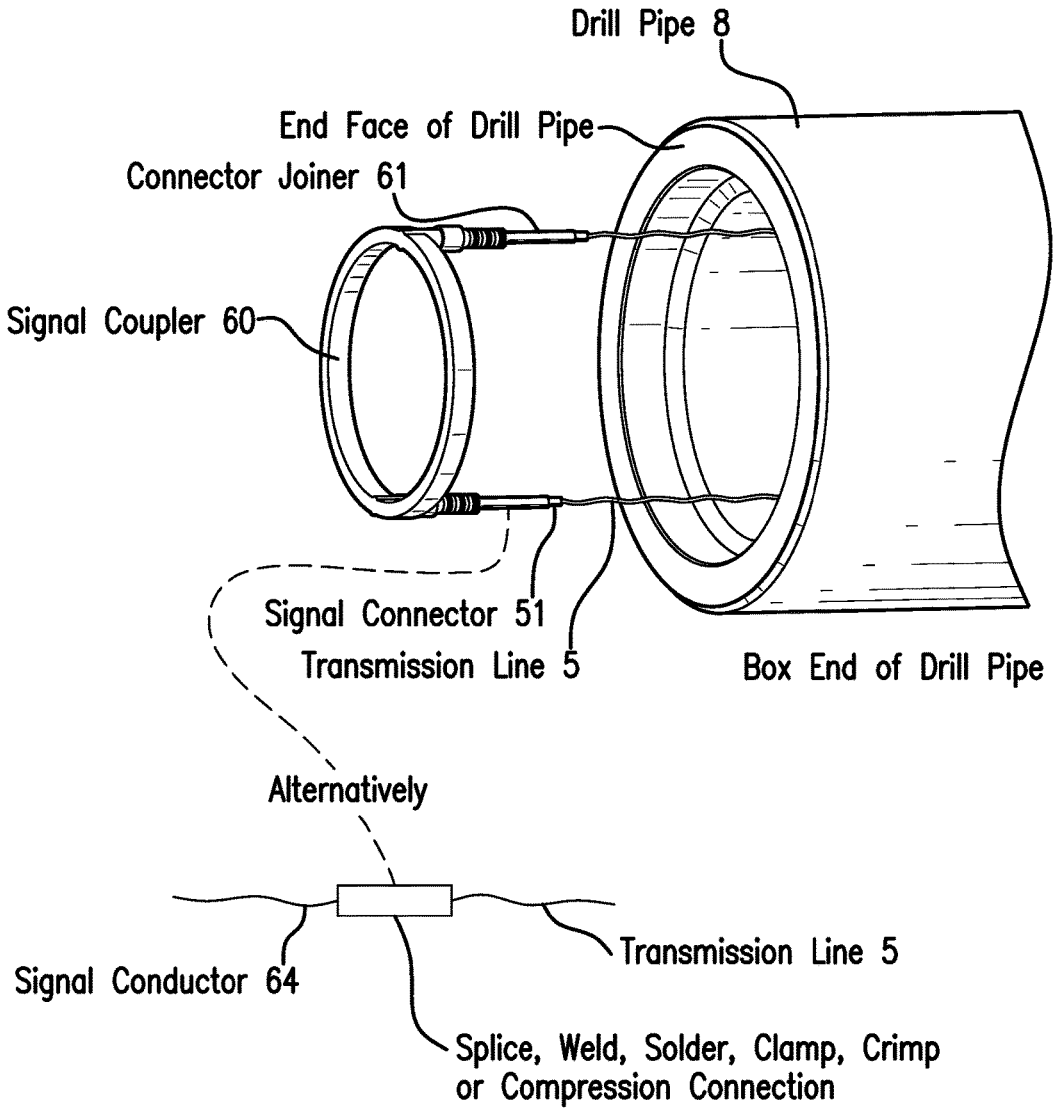
Figure 6C:
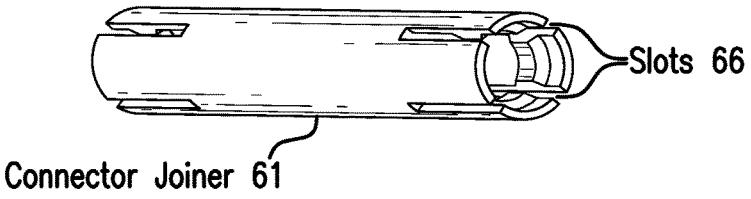
Figure 6D:
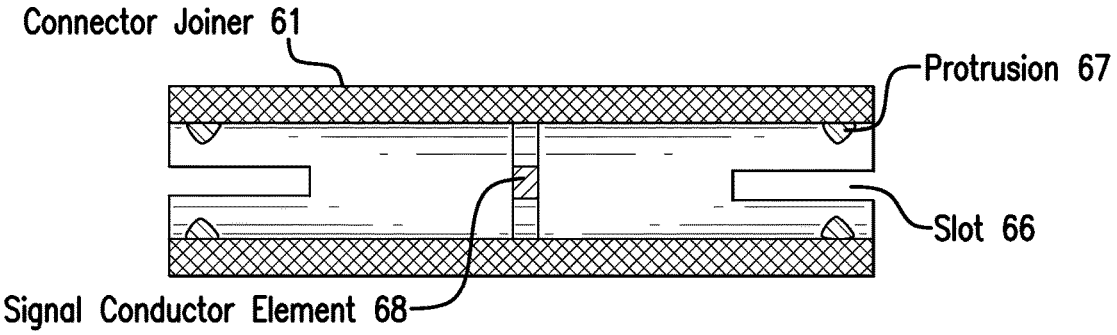

FIG. 5 depicts aspects of the transmission line 5 extending from the box end of the drill pipe in a three-dimensional view. This is possible because the transmission line can be moved inside of the protection tube 20. Extending the transmission line 5 from the end of the drill pipe allows for making up a connection to the transmission line. The end of the transmission line 5 may have a signal connector 51 as shown for connection to the signal coupler 60, for example, by connector plugs well known in the art or by a connector joiner described below, or the end of the transmission line may be configured to be soldered, welded, clamped, crimped, compressed, or spliced to a signal lead such as the signal conductor 64 (FIG. 6A) extending from the signal coupler (see FIG. 6B for example). FIG. 5 shows a position for making the electrical connection between the signal coupler 60 (FIG. 6A) and the transmission line 5 at the box side of the drill pipe 8. In a later step, the transmission line 5 can be pulled from the pin side or from inside the drill pipe 8 or the transmission line 5 retracts due to its tension so that the transmission line 5 is encased by the protection tube 20 and the signal coupler 60 which rests inside the respective recess 25.

FIG. 6 depicts aspects of connecting the transmission line 5 to a signal coupler 60. FIG. 6A illustrates the signal coupler 60 and the transmission line 5 before connection in a three-dimensional view. The signal coupler 60 includes a mechanical connector 65 configured to be inserted into the connector sleeve 21 and seal against an inner sealing surface in the connector sleeve 21. A connector joiner 61 is configured to connect the signal connector 51 of the transmission line 5 to a signal conductor 64 of the coupler connector 62 as part of the signal coupler 60. It can be appreciated that the connector joiner 61 may be sized to carry the dynamic load of the transmission line 5. Alternatively, the transmission line 5 is connected to the signal conductor 64 without the signal connector 51 and/or the coupler connector 62 as described above. The signal conductor 64 for conducting a signal to or from the signal coupler 60 is illustrated in FIG. 6A. FIG. 6B illustrates the signal coupler 60 connected to the transmission line 5 at the box end of the drill pipe in a three-dimensional view. The transmission line 5 and the signal coupler 60 are illustrated in FIG. 6B before final installation of the transmission line and the signal coupler into the box end of the drill pipe. The transmission line extends past the end face of the box end of the drill pipe to provide sufficient length or slack for making the electrical connection before the signal coupler is inserted into the recess 25. FIG. 6C depicts aspects of the connector joiner 61 in a three-dimensional view. In the embodiment of FIG. 6C, the connector joiner 61 is a female connector joiner having one or more slots 66. Those skilled in the art will appreciate that other configurations such as male-male, male-female, or female-male connections would be possible as well. The connector joiner may be of conical shape or may have a tapered surface (not shown) or may be otherwise shaped to facilitate the installation. The one or more slots 66 are configured to enable the outer diameter of the connector joiner 61 to radially expand in order to receive the signal connector 51 and the coupler connector 62. When both signal connector 51 and coupler connector 62 are inserted into the connector joiner 61, the transmission line 5 is in signal communication with the signal coupler 60. FIG. 6D depicts aspects of the connector joiner 61 in a cross-sectional view. The connector joiner 61 includes one of more cylindrical layers of insulation (not shown) to electrically isolate signal conductors from the outside of the connector joiner 61. Inside the connector joiner 61 is a signal conductor element 68 configured to contact a conductor from each of the inserted signal connector 51 and coupler connector 62 in order to conduct a signal. Other ways of connecting the transmission line 5 and the signal coupler 60, for example by directly connecting the signal connector 51 to the coupler connector 62 by a plug connection or an inductive or capacitive coupling means are alternative ways of establishing a connection of transmission line 5 and signal coupler 60 within the connector joiner 61. The connector joiner 61 further includes one of more protrusions 67 configured to move radially due to the slots 66 and then to mechanically engage the signal connectors in order to secure the signal connector 51 and the coupler connector 62 to the connector joiner 61. When the connector joiner 61 is inserted into the connector sleeve 21, the outer diameter of the connector joiner 61 is no longer able to radially expand thereby preventing the signal connector 51 and the coupler connector 62 from disengaging with the connector joiner 61. It can be appreciated that in one or more embodiments such as the embodiment depicted in FIG. 6B, the signal connector 51 may not be required. In another embodiment, the mechanical connector and the coupler connect can be one integral part. In yet another embodiment, the connector sleeve and the protection tube can be one integral part, at least at one side of the drill pipe. Alternatively, the connector sleeve and the protection tube can be pre-configured. In yet another embodiment, the mechanical connector and the connector sleeve can be one integral part, thus eliminating the need for a sealing surface.

It can be appreciated that the connector joiner 61 features one or more electrical conductors making electrical connections to the coupler connector 62 and the signal connector 51 to allow the communication between signal couplers at pin and box sides of the drill pipe through multiple contacts of the transmission line such as with coaxial cable, triaxial cable, twisted pair cable, multiwire cable, and the like.

Figure 7:
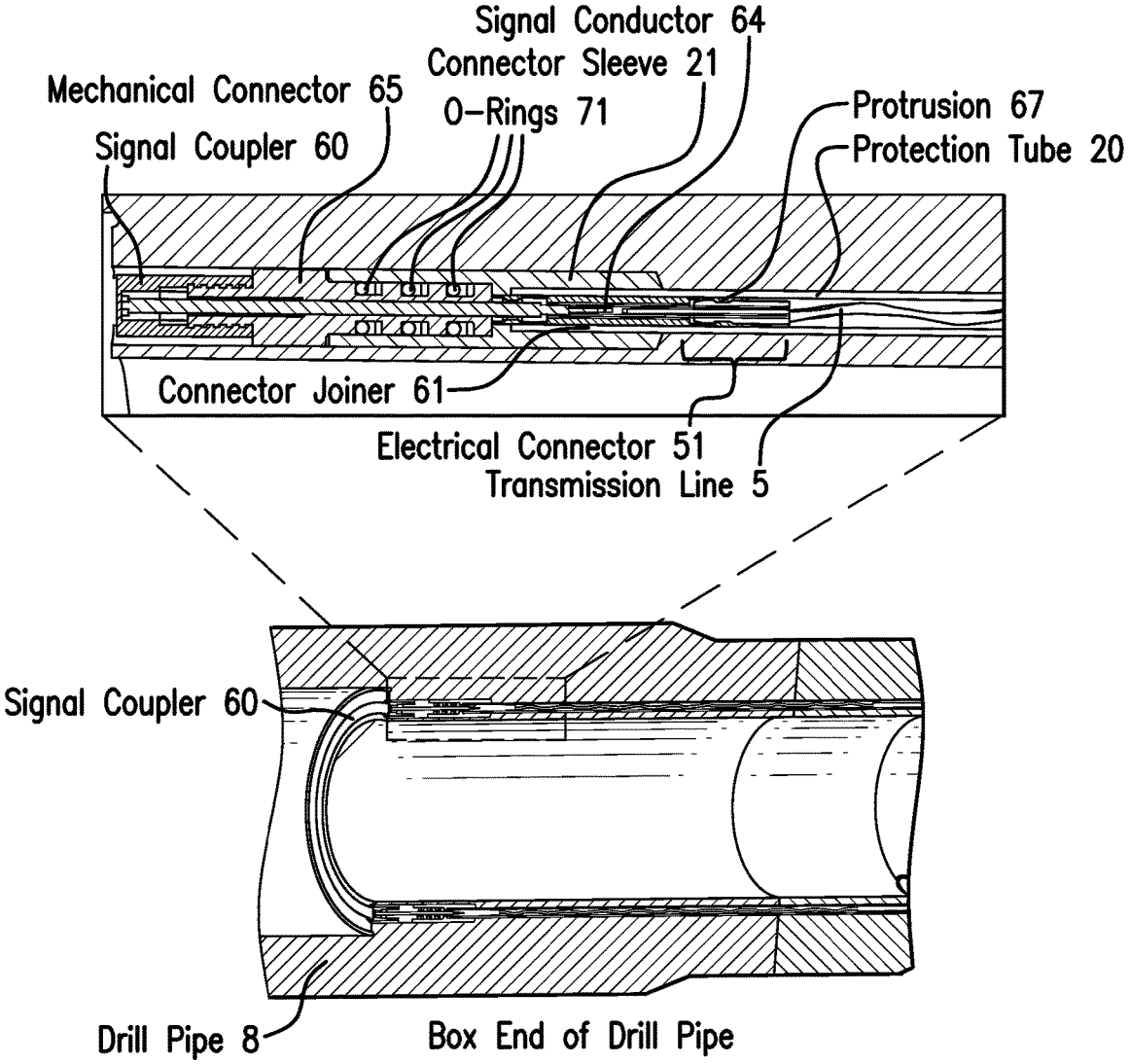
FIG. 7 depicts aspects of a mechanical connection and a signal connection made within the connector sleeve at the box end of the drill pipe using the female connector joiner.

FIG. 7 depicts aspects of a mechanical connection made between the signal coupler and the connector sleeve at the box end of the drill pipe in a cross-sectional view. As illustrated in FIG. 7, the mechanical connector 65 includes one or more O-rings 71 that form a compression seal or any other suitable type of sealing. It can be appreciated that while only one O-ring 71 is required to form a seal, two or more O-rings provide redundant seals in case one of the O-rings fail. The O-rings 71 are made of a suitable compressible material such as rubber or a fluoroelastomer that is specified to survive in the downhole environment, which can include high temperatures approaching or exceeding 200° C. and exposure to the drilling fluid. The signal conductor 64 extends through the mechanical connector 65 to the signal coupler 60 as illustrated.

As the signal coupler 60 is being inserted into the recess 25 or recess 45, the excess length or slack of the transmission line 5 is inserted into the protection tube 20. In one or more embodiments, the transmission line 5 substantially rests free or has freedom of movement within the protection tube 20 for at least part of the length of the protection tube 20 in order to enable each end of the transmission line to be extended from either end of the protection tube so that connections can be made or the system can be properly assembled otherwise. In one or more embodiments, the transmission line 5 is under tension when inserted into the protection tube 20 and/or when extended from one end of the protection tube 20 so that connections can be made or the system can otherwise be assembled. Alternatively, in other embodiments, the transmission line 5 is not under tension when inserted into the protection tube 20 so that connections can be made or the system can be otherwise assembled. Another advantage of having the transmission line 5 rest free in the protection tube 20 is that the transmission line in the protection tube can be displaced in order to make room for the slack that is being inserted into the protection tube as the signal coupler is being inserted into the corresponding recess. In one or more embodiments, the transmission line 5 includes a signal transmission medium (e.g., electrical conductors) that is wrapped around or woven through an elastic material such that the transmission line can be pulled to extend its length beyond the length of the protection tube and when released the transmission line will retract into the protection tube. In one or more embodiments, the transmission line 5 is a stretchable elastic electrical cord such one referred to as Roboden and available from Asahi Kasel Fibers of Japan.

Figure 8A:
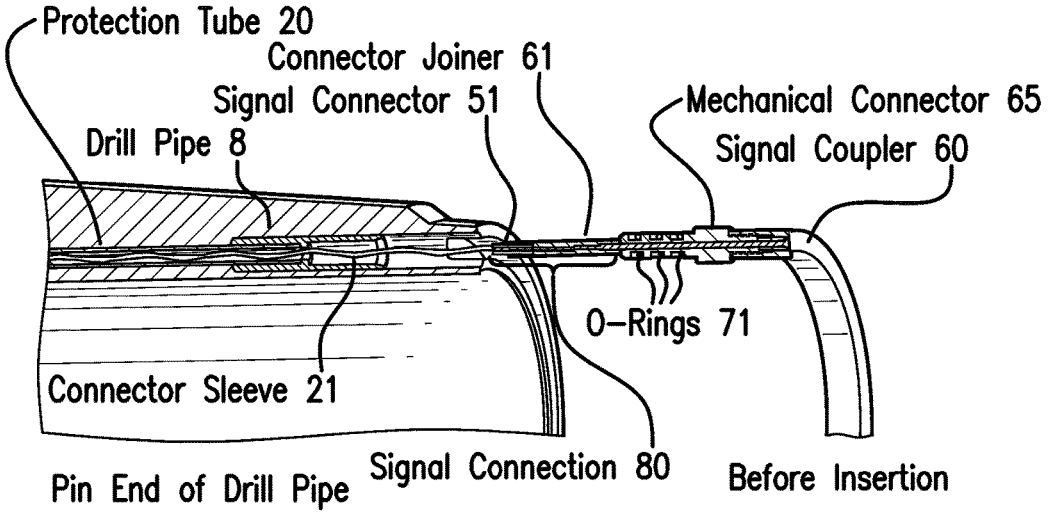
FIGS. 8A and 8B, collectively referred to as FIG. 8, depict aspects of a mechanical connection and a signal connection made at the pin end of the drill pipe.
Figure 8B:
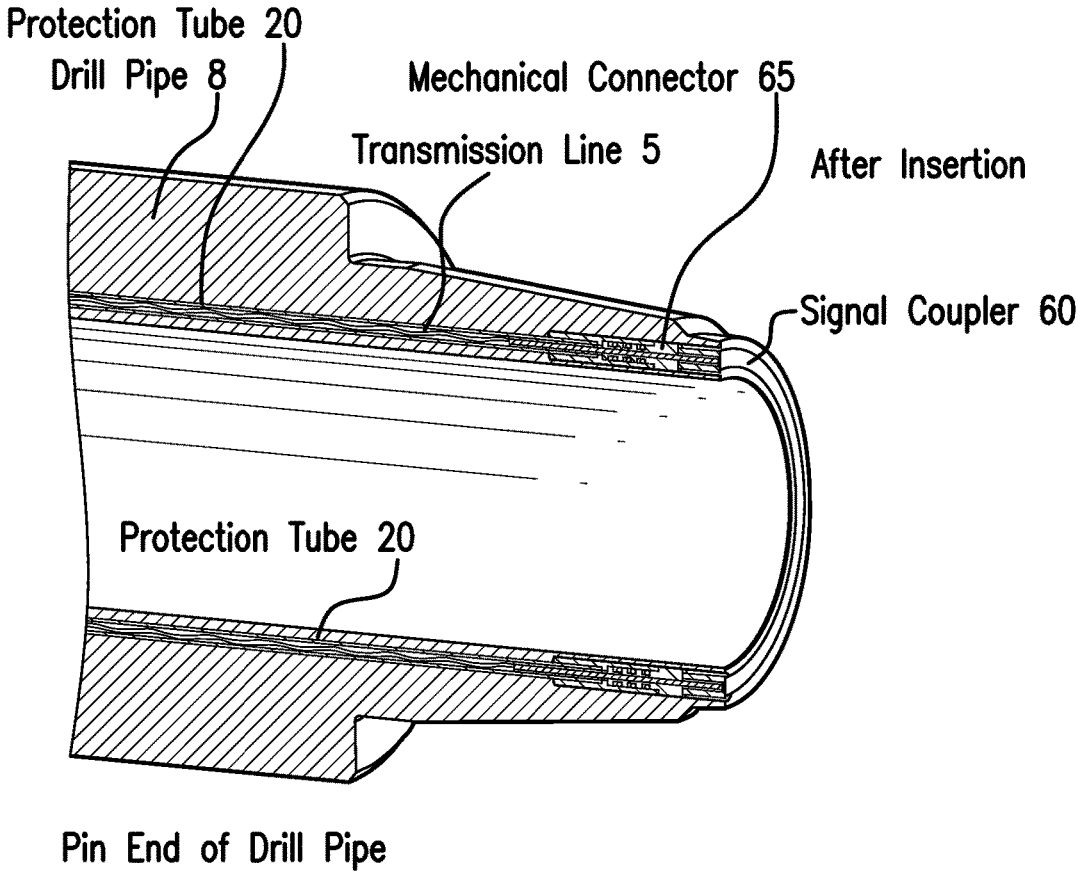

FIG. 8 depicts aspects of a mechanical connection and a signal connection made at the pin end of the drill pipe. FIG. 8A illustrates a made up signal connection 80 before the signal coupler 60 is inserted into the recess 45 at the box end of the drill pipe. FIG. 8A also displays the required surplus length or slack to make a final electrical connection to allow for communication from one drill pipe side to the other. The length of the transmission line 5 extending from the connector sleeve outwards is selected to be able to make up the signal connection 80. In one or more embodiments, the length extending from the connector sleeve equals at least the length from the connector sleeve to the end face of the drill pipe at the pin end. FIG. 8B illustrates the signal coupler 60 inserted into the connector sleeve 21 with the mechanical connector 65 sealing to the interior sealing surface of the connector sleeve 21. It can be seen that in this embodiment with the signal coupler 60 inserted the outer surface of the signal coupler is flush or recessed with respect to the end face of the drill pipe at the pin end.

Figure 9:
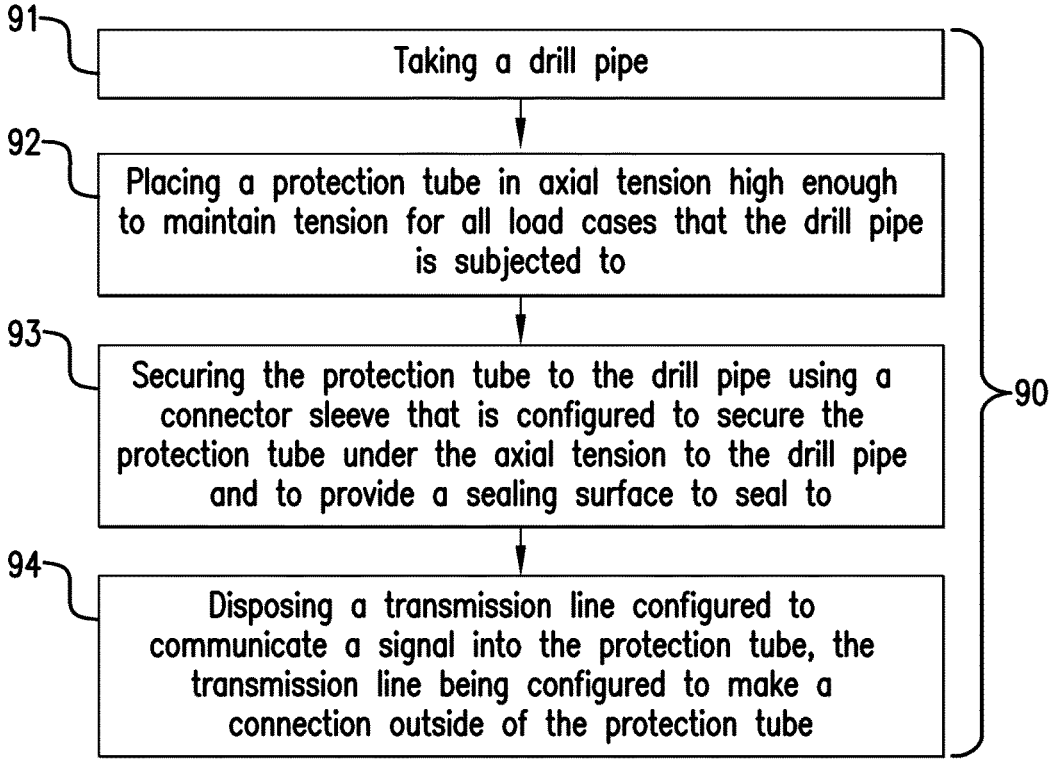
FIG. 9 is a flow chart for a method for building an apparatus for communicating a signal to or from a downhole tool.

FIG. 9 is a flow chart for a method 90 for building an apparatus for communicating a signal to or from a downhole tool. Block 91 calls for taking a drill pipe. Block 92 calls for placing a protection tube in axial tension high enough to maintain tension for all load cases that the drill pipe is subjected to. Block 93 calls for securing the protection tube to the drill pipe using a connector sleeve that is configured to secure the protection tube under the axial tension to the drill pipe and to provide a sealing surface to seal to. In one or more embodiments, the sealing surface is configured to seal to a connector. In one or more embodiments, after one end of the protection tube is secured to the drill pipe using the first connector sleeve, the other protection tube end is stretched, for instance by using a gripper device having a plier-like gripper that grips and pulls the protection tube. After the protection tube is stretched and cut to the required final length, the second connector sleeve may be secured to that end and the gripper device is released. When the circumferential gripper is released, the protection tube will retract back into the drill pipe until the second connector sleeve engages the drill pipe keeping the protection tube in axial tension. The amount of axial tension is such that the axial tension is maintained even when the drill pipe is not under axial tension or is under axial compression or bending within ranges that typically occur in downhole applications. Block 94 calls for disposing a transmission line into the protection tube such as from the box end side of the drill pipe. The transmission line is configured to communicate a signal to or from the downhole tool and allows for making an electrical connection outside of the protection tube. The transmission line is not fixed to the protection tube between ends of the protection tube for at least a part of the protection tube. "Not fixed" relates to the transmission line laying free in the protection tube such that the transmission line may be moved in the protection tube, e.g., by pulling it from an end of the protection tube.

Figure 10:
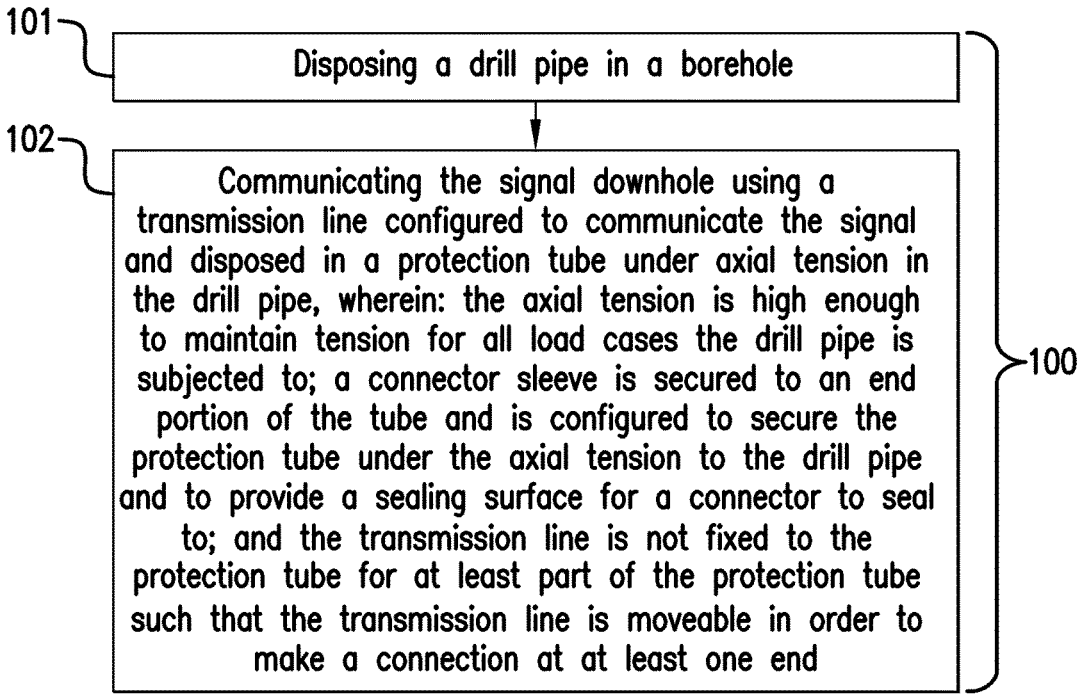
FIG. 10 is flow chart for a method for communicating a signal to or from a downhole tool.

FIG. 10 is a flow chart for a method 100 for communicating a signal to or from a downhole tool. Block 101 calls for disposing a drill pipe in a borehole. Block 102 calls for communicating the signal downhole using a transmission line disposed in a protection tube under axial tension in the drill pipe wherein the axial tension is high enough to maintain tension for all load cases the drill pipe is subjected to while in normal operation. A connector sleeve is secured to an end portion of the protection tube and is configured to secure the protection tube under the axial tension to the drill pipe and to provide a sealing surface for a mechanical connector to seal against. The transmission line is not fixed to the protection tube for at least a part or portion of the protection tube such that the transmission line is moveable (e.g., to be pulled and extended from an end of the protection tube) to make a connection at at least one end. In one or more embodiments, the transmission line may not be secured or fixed to the protection tube for the length of the protection tube. In one or more embodiments, the transmission line may be secured or fixed to the protection tube between ends of the protection tube. It can be appreciated that once a connection is made at an end of the transmission line, that transmission line end may be considered secured by that connection. The method 100 may also include transmitting the signal between each of the drill pipes in the drill string and/or between a downhole tool disposed at (i.e., in or on) the drill string and a receiver located at or near the tool or somewhere else in the drill string or at the surface using signal couplers.

Figure 11:
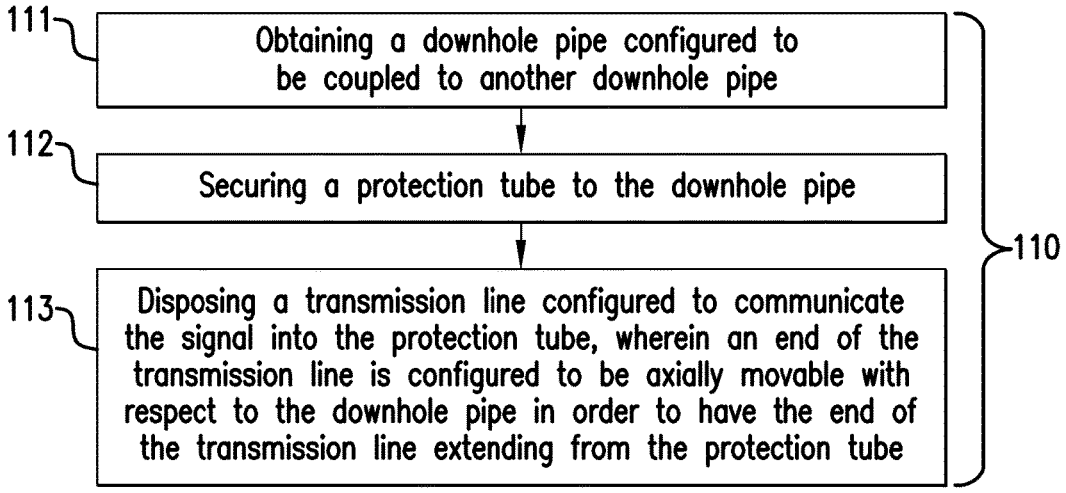
FIG. 11 is a flow chart for another method for building an apparatus for communicating a signal to or from a downhole tool.

FIG. 11 is a flow chart for a method 110 for building or repairing an apparatus for communicating a signal to or from a downhole tool. "Repair" relates to re-building after use of the apparatus in order to repair the apparatus by repairing or replacing one or more parts of the apparatus. Block 111 calls for obtaining a downhole pipe configured to be coupled to another downhole pipe. The term "downhole pipe" is meant to be inclusive of drill pipe and other types of pipe that may be used downhole and through which a signal may be communicated. Block 112 calls for securing a protection tube to the downhole pipe. Block 113 calls for disposing a transmission line configured to communicate the signal into the protection tube, wherein an end of the transmission line is configured to be axially moveable with respect to the downhole pipe in order to have the end of the transmission line extending from the protection tube. The transmission line may be not fixed to the protection tube for at least a part or portion of the protection tube so that the transmission line is moveable (e.g., to be pulled and extended from an end of the protection tube) to make a connection at at least one end of the transmission line. In one or more embodiments, the transmission line may not be secured or fixed to the protection tube for the length of the protection tube. In one or more embodiments, the transmission line may be secured or fixed to the protection tube at one or more locations between ends of the protection tube. In one or more embodiments, the transmission line has a length greater than the length of the protection tube or a length to allow for making an electrical connection outside of the protection tube. It can be appreciated that once a connection is made at an end of the transmission line, that transmission line end may be considered secured by that connection. The method 110 may also include moving the end of the transmission line longitudinally with respect to the downhole pipe to communicatively connect it to a communication device to form a connection and/or to seal it to a sealing device wherein the moving may occur while movement of the other end of the transmission line is restricted with respect to at least one axial direction. The method 110 may also include putting the protection tube under axial tension and securing and sealing the protection tube to the downhole pipe, wherein the axial tension is high enough to maintain tension for all load cases the drill pipe is subjected to under normal operation conditions including assembly as well as repair and maintenance. It can be appreciated that the protection tube will remain under axial tension even as the drill pipe experiences axial tension or undergoes bending or flexing. The method 110 may also include connecting the protection tube to a connector sleeve. The method 110 may also include installing a connector joiner to the transmission line.

Figure 12:
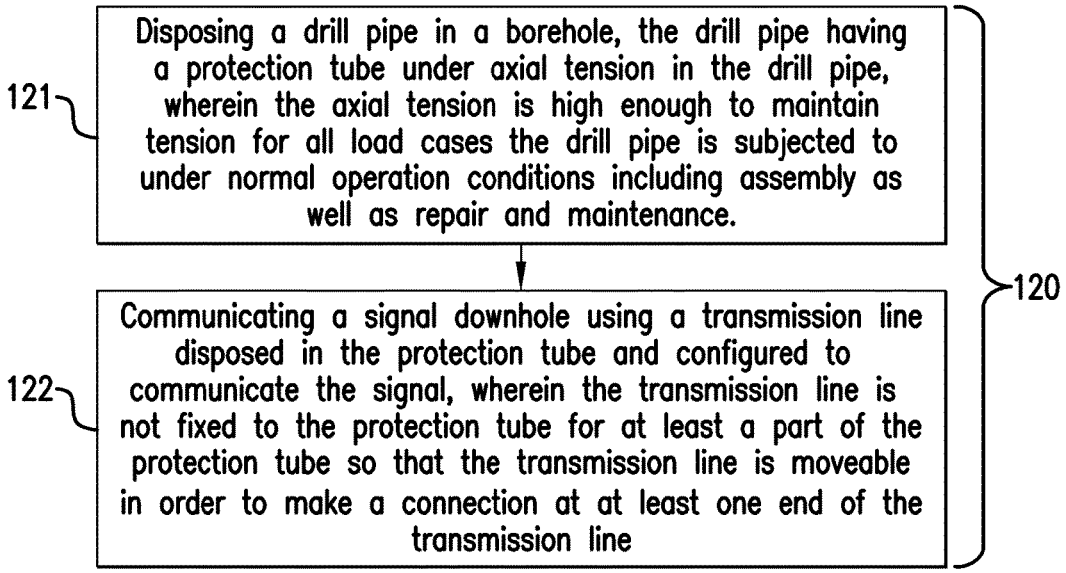
FIG. 12 is a flow chart for another method for communicating a signal to or from a downhole tool.

FIG. 12 is a flow chart for a method 120 for communicating a signal to or from a downhole tool. Block 121 calls for disposing a drill pipe in a borehole, the drill pipe having a protection tube under axial tension in the drill pipe, wherein the axial tension is high enough to maintain tension for all load cases the drill pipe is subjected to under normal operation conditions including assembly as well as repair and maintenance. Block 122 calls for communicating the signal downhole using a transmission line disposed in the protection tube and configured to communicate the signal, wherein the transmission line is not fixed to the protection tube for at least a part or portion of the protection tube so that the transmission line is moveable (e.g., to be pulled and extended from an end of the protection tube) to make a connection at at least one end of the transmission line. "Not fixed" relates to the transmission line resting free or having freedom to move for at least a part of the protection tube.

The above disclosed techniques provide several advantages. One advantage is that having the protection tube under axial tension provides greater rigidity and therefore greater resistance to flexing due to drill string vibration. Another advantage of having the protection tube disposed in each drill pipe is to protect the transmission line from the flow of drilling fluid internal to the drill pipes. Yet another advantage is the overall mass of the small transmission line is small enough such that the forces imposed on the transmission line by vibrations and accelerations during normal operations are small enough to not damage the transmission line without supporting the transmission line between end points in the protection tube. These forces imposed on the transmission line may be transferred to the connector sleeves via the signal connectors leaving the transmission line substantially free to move within the protection tube for at least part of the protection tube.

Several advantages are provided by the not affixing the transmission line to the protection tube for at least part of the protection tube. These advantages include: not requiring special length adjustment connectors to connect to the transmission line; periodic elongation of a drill pipe and associated protection tube is not transmitted to the transmission line leading to improved reliability; more robust design with less parts, replacement or repair of the transmission line is possible without affecting other portions of the design and, thus, more efficient and economical; less connectors are required resulting in less signal attenuation; and a force resulting from ambient pressure is directly supported by the connector sleeves instead of being transmitted to less robust parts where damage may occur.

Use of the thin transmission line provides advantages. One advantage is that the outer diameter of the protection tube can be decreased enabling a higher flow rate of drilling fluid in the drill string. Another advantage is that the holes in the end portions of the drill pipe that are drilled to accept the protection tube may be decreased in diameter to accept the smaller diameter protection tube thus increasing the strength and rigidity of the drill pipe.

It can be appreciated that while the above disclosure is directed to the protection tube being secured in the bore of a drill pipe, the protection may also be disposed in a mud channel, a milled groove or gland. Further, the protection tube may be disposed in other types of downhole pipes such as pipes for fishing, pipes for conveyed logging, and pipes for well completion for example. The term "downhole pipe" is used to be inclusive of any pipe or pipe segment used in borehole applications such as for drilling, logging, fishing, completion, etc. into which the protection tube may be disposed.

In support of the teachings herein, various analysis components may be used, including a digital and/or an analog system. For example, the downhole tools 10, the downhole electronics 11, the sensors, or the computer processing system 12 may include digital and/or analog systems. The system may have components such as a power supply, processor, microcontroller, storage media, memory, input, output, communications link (wired or optical or other), user interfaces, software programs, signal processors (digital or analog) and other components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., one of a generator, a remote supply and a battery), magnet, electromagnet, sensor, electrode, transmitter, receiver, transceiver, antenna, transducer, radioactive source, neutron generator, controller, optical unit, connector, splice, electrical unit or electromechanical unit may be included in support of the various aspects discussed herein or in support of other functions beyond this disclosure.

Elements of the embodiments have been introduced with either the articles "a" or "an". The articles are intended to mean that there are one or more of the elements. The terms "including" and "having" and the like are intended to be inclusive such that there may be additional elements other than the elements listed. The conjunction "or" when used with a list of at least two terms is intended to mean any term or combination of terms. The terms "first," "second" and the like do not denote a particular order, but are used to distinguish different elements. The term "configured" relates to a structural limitation of an apparatus that allows the apparatus to perform the task or function for which the apparatus is configured.

The flow diagrams and method steps depicted herein are just examples. There may be many variations to these diagrams or the steps (or operations) described therein without departing from the spirit of the invention. For instance, the steps may be performed in a differing order, or steps may be added, deleted or modified. All of these variations are considered a part of the claimed invention.

While one or more embodiments have been shown and described, modifications and substitutions may be made thereto without departing from the spirit and scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for communicating a signal downhole, the apparatus comprising:

a drill string configured to drill a borehole into the earth, the drill string comprising:

a downhole pipe configured to be coupled to another downhole pipe;

a protection tube secured under axial tension to the downhole pipe, the protection tube having a shifted natural resonant frequency due to the axial tension such that the resonant frequency is tuned or shifted to prevent damage during drill string vibration;

a transmission line disposed in the protection tube and configured to communicate the signal;

a communication device disposed in the downhole pipe and configured to communicate the signal to another downhole pipe;

a connector coupled to an end of the transmission line and configured to connect the transmission line to the communication device, wherein a portion of the transmission line not fixed to the protection tube has a weight such that the weight of the portion of the transmission line and a dynamic load on the portion of the transmission line resulting from accelerations of the portion of the transmission line due to drilling is withstood by the connector;

wherein an end of the transmission line is configured to be axially movable with respect to the protection tube in order to have the end of the transmission line extending from the protection tube to establish a connection between the transmission line and the communication device; and wherein the protection tube is configured to store the length of the transmission line extending from the protection tube;

wherein the transmission line is not secured to the protection tube between end connections of the transmission line.

2. The apparatus according to claim 1, wherein each end of the transmission line is axially movable with respect to the downhole pipe in order to have at least one end of the transmission line extending from the protection tube.

3. The apparatus according to claim 1, wherein an interior of the protection tube is sealed against fluid.

4. The apparatus according to claim 1, wherein the protection tube is coupled to or comprises a radially expanded region such that the expanded region prevents axial movement of the protection tube in at least one direction.

5. The apparatus according to claim 4, wherein the radially expanded region comprises a sealing surface to a seal a connector against.

6. The apparatus according to claim 4, wherein the radially expanded region comprises a connector sleeve coupled to the protection tube and configured to secure the protection tube under the axial tension to the downhole pipe.

7. The apparatus according to claim 6, wherein the connector sleeve is connected to the protection tube by at least one of or a combination of a weld, a braze, soldering, an adhesive, a friction fit, swaging, a threaded connection, and use of memory shape material.

8. The apparatus according to claim 7, wherein the communication device comprises a signal coupler configured to communicate the signal to another signal coupler.

9. The apparatus according to claim 8, further comprising a connector joiner configured to connect a transmission line signal connector to a signal conductor of the signal coupler.

10. The apparatus according to claim 9, wherein the connector joiner is configured to be inserted into the protection tube or the connector sleeve and at least part of the connector joiner is configured to expand to accept an end of the transmission line, the signal conductor, or coupler connector and wherein insertion prevents the at least a part of the connector joiner from expanding in order to secure the connector joiner to the end of the transmission line, the signal conductor, or the coupler connector.

11. The apparatus according to claim 8, further comprising further comprising at least one of a plug, splice, weld, solder, clamp, crimp, and compression connection configured to electronically connect the transmission line to the signal coupler.

12. A method for building or repairing an apparatus for communicating a signal downhole, the method comprising:

obtaining a downhole pipe configured to be coupled to another downhole pipe in order to make up a drill string configured to drill a borehole into the earth;

securing a protection tube under axial tension to the downhole pipe, the protection tube having a shifted natural resonant frequency due to the axial tension such that the resonant frequency is tuned or shifted to prevent damage during drill string vibration ; and disposing a transmission line configured to communicate the signal into the protection tube, wherein the transmission line is not secured to the protection tube between end connections coupler. of the transmission line;

disposing a communication device in the downhole pipe, the communication device configured to communicate the signal to another downhole pipe;

coupling a connector to an end of the transmission line, the connector configured to connect the transmission line to the communication device, wherein a portion of the transmission line not fixed to the protection tube has a weight such that the weight of the portion of the transmission line and a dynamic load on the portion of the transmission line resulting from accelerations of the portion of the transmission line due to drilling is withstood by the connector;

wherein an end of the transmission line is configured to be axially moveable with respect to the protection tube in order to have the end of the transmission line extending from the protection tube; and wherein the protection tube is configured to store the length of the transmission line extending from the protection tube.

13. The method according to claim 12, further comprising moving the end of the transmission line longitudinally with respect to the downhole pipe to communicatively connect it to a communication device to form a connection and/or to seal it to a sealing device.

14. The method according to claim 13, wherein the moving occurs while movement of the other end of the transmission line is restricted with respect to at least one axial direction.

15. The method according to claim 13, wherein the connection is made by using one or more techniques of plugging, splicing, welding, soldering, clamping, crimping, and compressing.

16. The method according to claim 12, further comprising connecting the protection tube to a connector sleeve.

17. The method according to claim 12, further comprising installing a connector joiner to the transmission line.

* * * * *